US008128184B2

(12) United States Patent
Allard et al.

(10) Patent No.: US 8,128,184 B2
(45) Date of Patent: Mar. 6, 2012

(54) DOUBLE-SIDED DOOR MODULE

(75) Inventors: Paul B. Allard, Stevensville, MI (US); James W. Kendall, Mount Prospect, IL (US); Alan S. Lucas, Evansville, IN (US); Andrew M. Tenbarge, Saint Joseph, MI (US); John J. Vonderhaar, Saint Joseph, MI (US); Guolian Wu, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 263 days.

(21) Appl. No.: 12/402,578

(22) Filed: Mar. 12, 2009

(65) Prior Publication Data

US 2009/0229187 A1 Sep. 17, 2009

Related U.S. Application Data

(60) Provisional application No. 61/035,775, filed on Mar. 12, 2008.

(51) Int. Cl.
*A47B 96/04* (2006.01)

(52) U.S. Cl. ..... 312/405.1; 312/404; 312/295

(58) Field of Classification Search ..... 312/402, 312/404, 405, 405.1, 291–292, 293.1, 295, 312/305; 62/441
See application file for complete search history.

(56) References Cited

U.S. PATENT DOCUMENTS

| | | | | | |
|---|---|---|---|---|---|
| 2,281,430 | A * | 4/1942 | Grant | 312/292 |
| 2,441,376 | A * | 5/1948 | Stiening | 62/381 |
| 3,171,135 | A * | 3/1965 | Polichio | 401/129 |
| 3,218,111 | A * | 11/1965 | Steiner | 312/405.1 |
| 4,095,439 | A * | 6/1978 | Linstromberg | 62/344 |
| 4,124,262 | A * | 11/1978 | Schill | 312/305 |
| 4,306,757 | A * | 12/1981 | Horvay et al. | 312/292 |
| 4,586,347 | A * | 5/1986 | McCarty | 62/265 |
| 5,893,531 | A * | 4/1999 | Taylor et al. | 242/598.6 |
| 7,254,958 | B2 * | 8/2007 | Kim et al. | 62/265 |
| 7,869,201 | B2 * | 1/2011 | McCoy et al. | 361/679.07 |
| 2003/0085237 | A1 | 5/2003 | Kateman et al. | |
| 2009/0223243 | A1 * | 9/2009 | Lee | 62/449 |

FOREIGN PATENT DOCUMENTS

| | | | |
|---|---|---|---|
| EP | 1724539 | A2 | 11/2006 |
| EP | 1788329 | A2 | 5/2007 |
| KR | 20199533939 | Y1 | 11/1995 |

* cited by examiner

*Primary Examiner* — Hanh V Tran
(74) *Attorney, Agent, or Firm* — Kirk W. Goodwin; Price Heneveld, LLP

(57) ABSTRACT

A door assembly for an appliance includes a door having an interior side and an exterior side. A frame defines an aperture extending through the door from the interior side to the exterior side. A module is disposed in the aperture. The module includes a first component and a second component. The second component disengageably connects with the first component. A pivot member is operably coupled with the module and with the frame. The module is rotatable about the pivot member thereby allowing access to both the first component and the second component from the exterior side of the door body.

17 Claims, 12 Drawing Sheets

DOUBLE-SIDED DOOR MODULE

CROSS-REFERENCE TO RELATED APPLICATION

This application claims the benefit under 35 U.S.C. §119 (e) of U.S. Provisional Patent Application No. 61/035,775, entitled "APPLIANCE WITH SPACE MANAGEMENT MODULES," filed on Mar. 12, 2008, the entire disclosure of which is hereby incorporated herein by reference.

BACKGROUND OF THE PRESENT INVENTION

The present invention generally relates to an appliance module and, more specifically, to an appliance module that is rotatable in an appliance door.

SUMMARY OF THE INVENTION

In one aspect of the present invention, a door assembly for an appliance includes a door having an interior side and an exterior side. A frame defines an aperture extending through the door from the interior side to the exterior side. A module is disposed in the frame. The module includes a first component and a second component. The second component disengageably connects with the first component. A pivot member is operably coupled with the module and with the frame. The module is rotatable about the pivot member thereby allowing access to both the first component and the second component from the exterior side of the door body.

In another aspect of the present invention, an appliance module includes a first side having a first component and a second side having a second component. A pivot member operably connects with the module. The pivot member allows rotation of the module in an appliance thereby providing access to either of the first or second components from an exterior portion of the appliance.

In yet another aspect of the present invention, a method of making an appliance module includes the step of providing an appliance with a frame defining a module receiving aperture. A module is provided having a first component removably coupled within a second component. A pivot member is connected to the module and removably connected to the frame. Utility lines extend through the pivot member to the module. The module rotates about the pivot member in the module receiving aperture.

These and other features, advantages and objects of the present invention will be further understood and appreciated by those skilled in the art upon studying the following specification, claims, and appended drawings.

DETAILED DESCRIPTION OF EMBODIMENTS

Figure 1A:
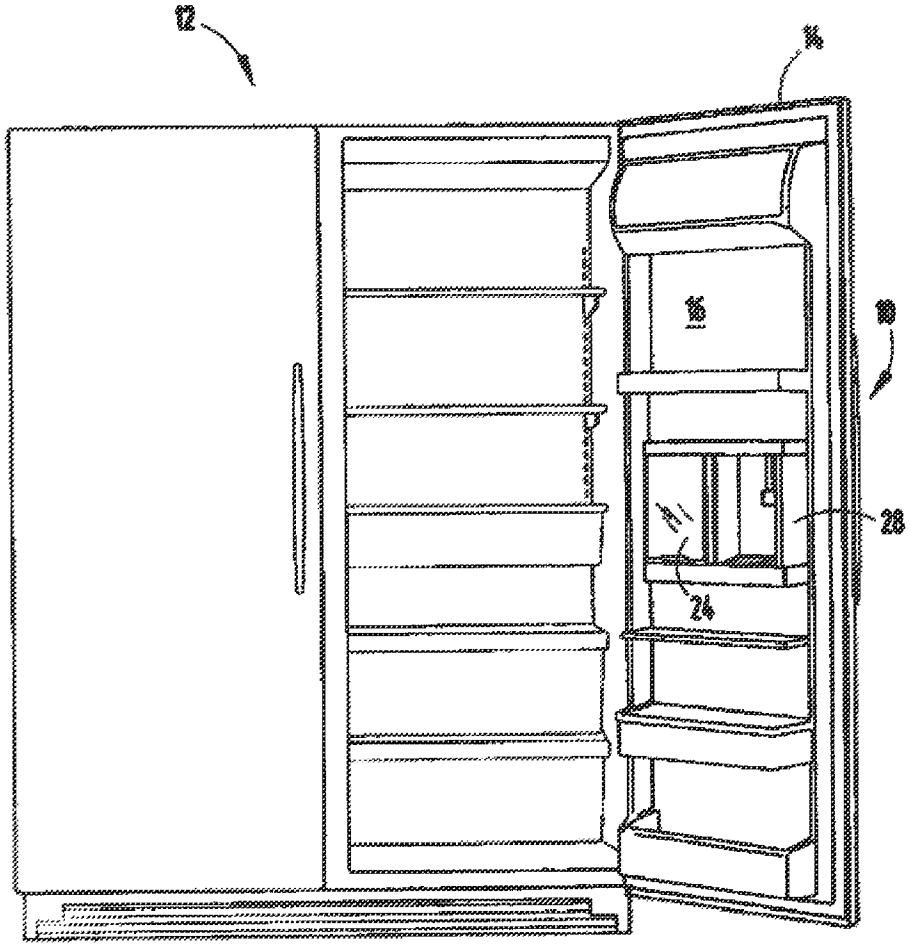
FIG. 1A is a front elevational view of the appliance of FIG. 1, with the door open.
Figure 1:
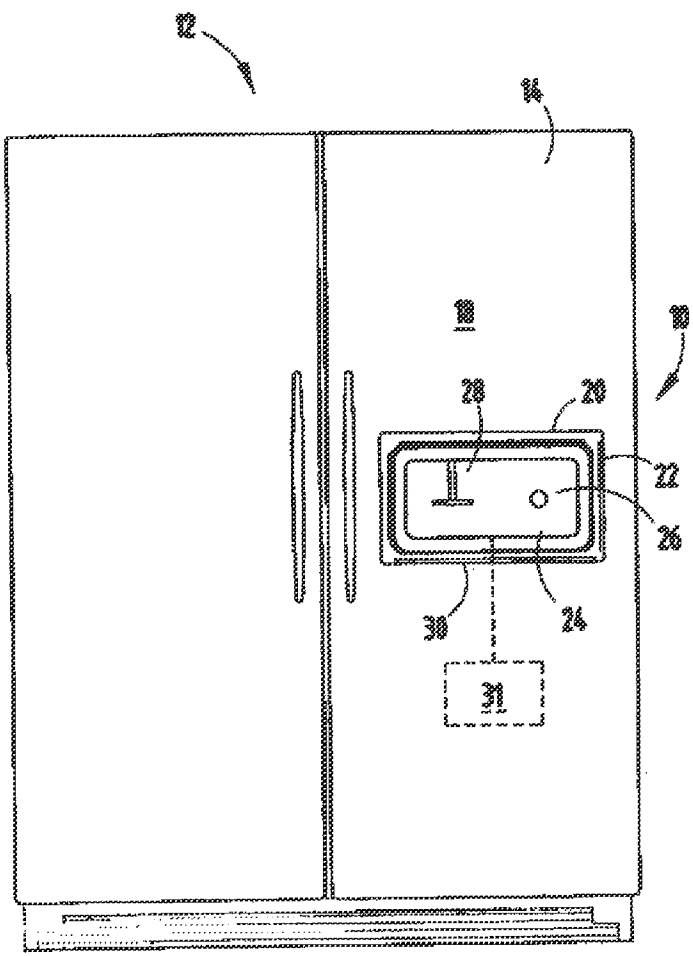
FIG. 1 is a front elevational view of a appliance incorporating one embodiment of a rotatable module of the present invention.

For purposes of description herein the terms "upper," "lower," "right," "left," "rear," "front," "vertical," "horizontal," and derivatives thereof shall relate to the invention as oriented in FIG. 1. However, it is to be understood that the invention may assume various alternative orientations and step sequences, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Referring to FIG. 1, the reference numeral 10 generally designates a door assembly for an appliance 12 having a door 14 with an interior side 16 and an exterior side 18. A frame 20 defines an aperture 22 extending through the door 14 from the interior side 16 to the exterior side 18. A module 24 is disposed in the frame 20. The module 24 includes a first component 26 and a second component 28. The second component 28 disengageably connects with the first component 26. A pivot member 30 is operably coupled with the module 24 and with the frame 20. The module 24 is rotatable about the pivot member 30 thereby allowing access to both the first component 26 and the second component 28 from the exterior side 18 of the door 14.

Figure 3:
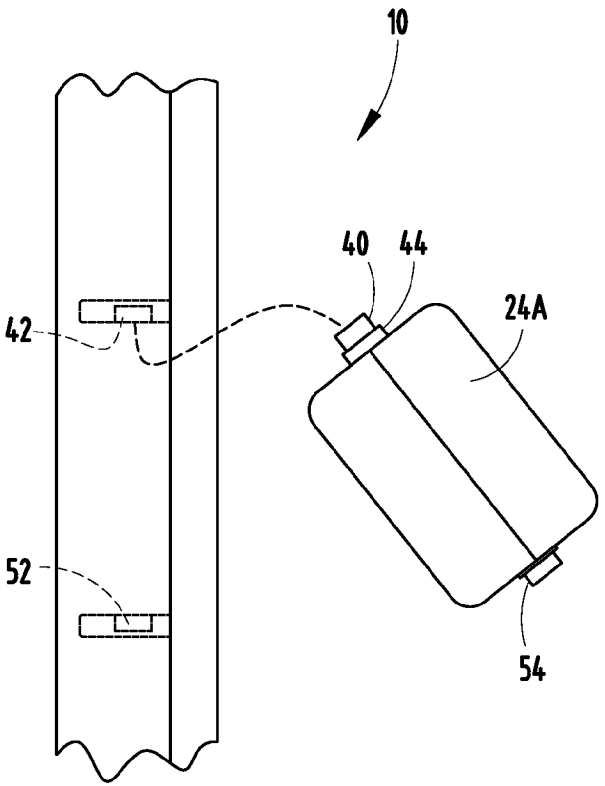
FIG. 3 is a side elevational view of a rotatable module during installation.
Figure 2:
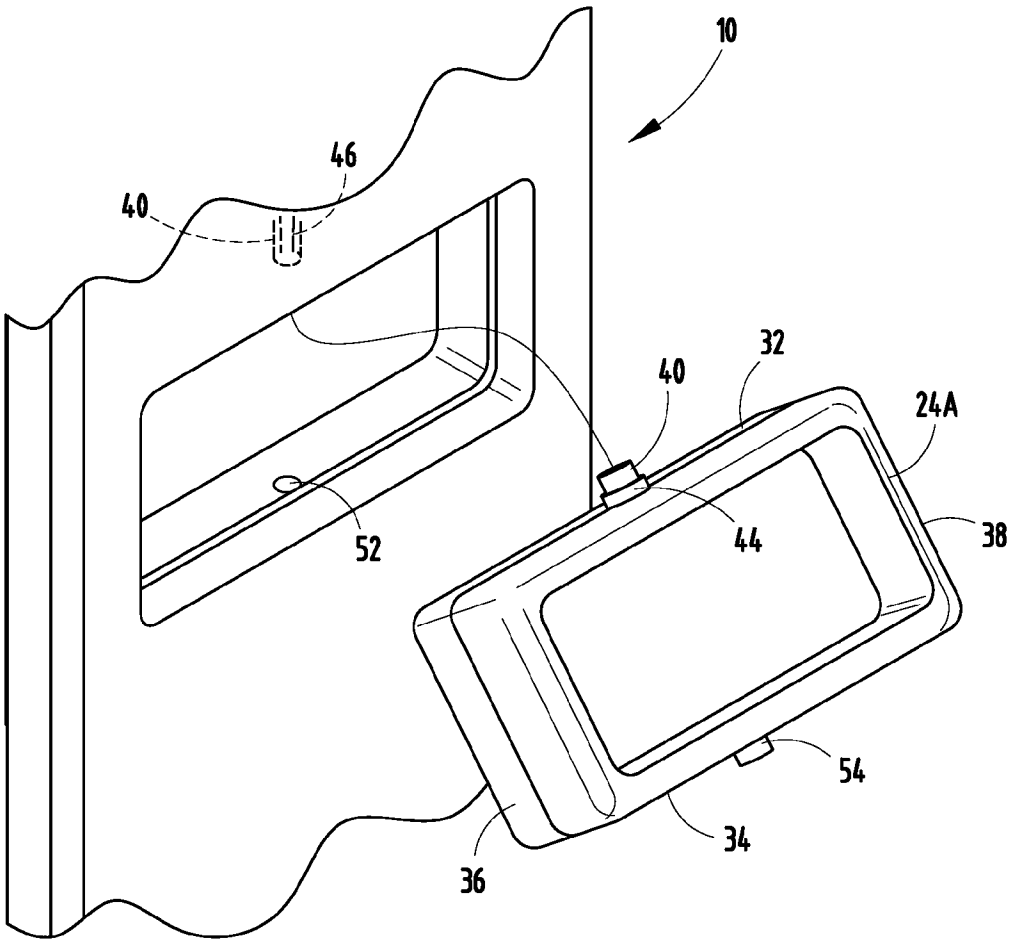
FIG. 2 is a front perspective view of a rotatable module during installation.

Referring now to FIGS. 1-3, the illustrated embodiment shows a removable module 24 in the appliance 12, which has an exterior side 18 and an interior side 16. A motorized device 31 may be operably connected with the module 24 to rotate the module 24 in the door 14. Alternatively, module 24 may be rotated manually by a user. The removable module 24 includes a top wall 32, a bottom wall 34, and first and second side walls 36, 38. The removable module 24 is installed by inserting an upper pivot pin 40 disposed on the top wall 32 of the removable module 24 into an upper receiving hole 42 in the removable module aperture 22. A pin gasket 44 extends around the upper pivot pin 40 and is designed to closely fit into the upper receiving hole 42, such that a secure connection with utility lines 46 can be made inside the upper receiving hole 42. A lower receiving hole 52 engages with a lower pivot pin 54 to secure the removable module 24 in place. The upper pivot pin 40 and lower pivot pin 54 allow for rotation of the removable module 24 in the module receiving aperture 22, as will be discussed in further detail below. It is conceived that any of a number of possible modules 24 arranged from various constructions of first and second components may be installed in the removable module aperture 22.

Figure 4C:
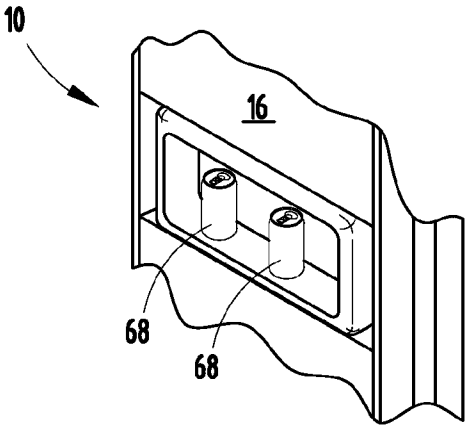
FIG. 4C is a rear perspective view of the rotatable module of FIG. 4A.
Figure 4B:
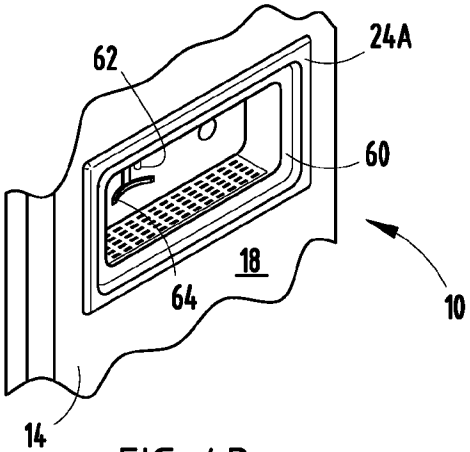
FIG. 4B is a front perspective view of the rotatable module of FIG. 4A.
Figure 4A:
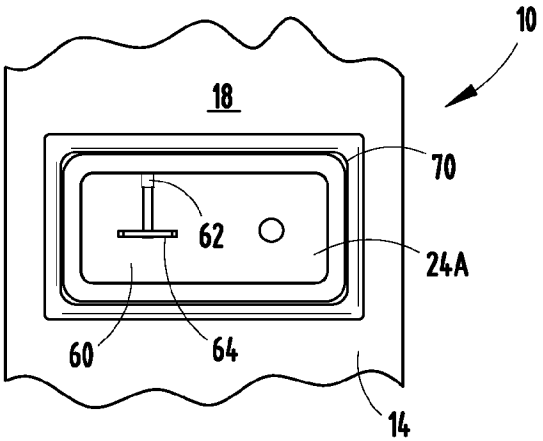
FIG. 4A is a front elevational view of a vertically rotatable module installed in a appliance.
Figure 4E:
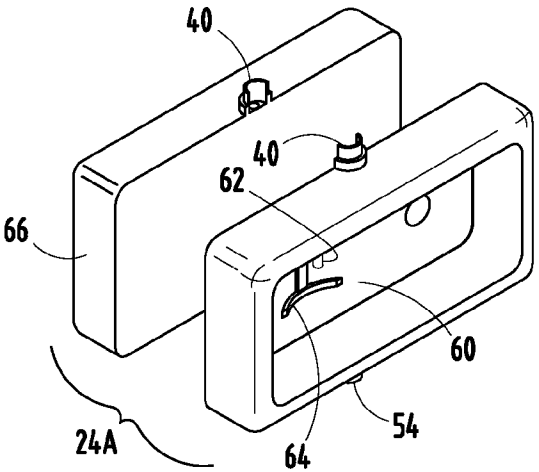
FIG. 4E is a top perspective view of the rotatable module of FIG. 4A with the first and second components disconnected.
Figure 4D:
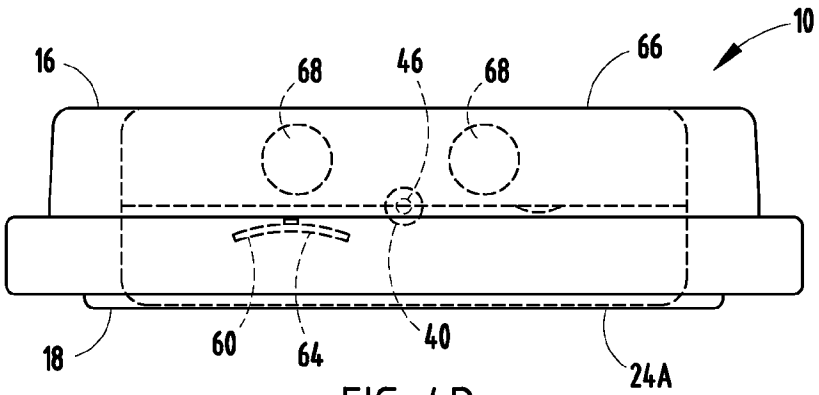
FIG. 4D is a top elevational view of the rotatable module of FIG. 4A.
Figure 5C:
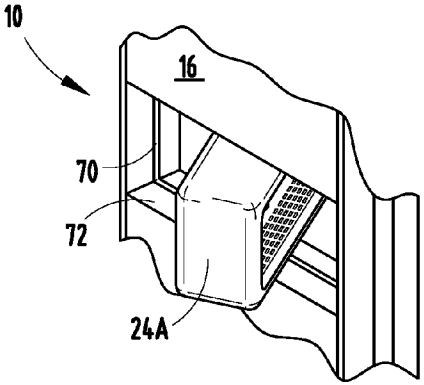
FIG. 5C is a rear perspective view of the rotatable module of FIG. 4A during rotation.
Figure 5B:
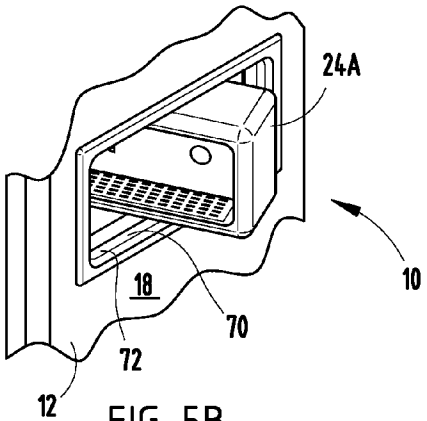
FIG. 5B is a front perspective view of the rotatable module of FIG. 4A during rotation.
Figure 5A:
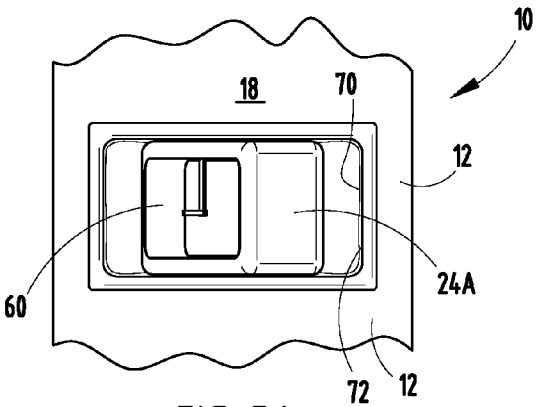
FIG. 5A is a front elevational view of the rotatable module of FIG. 4A during rotation.
Figure 5D:
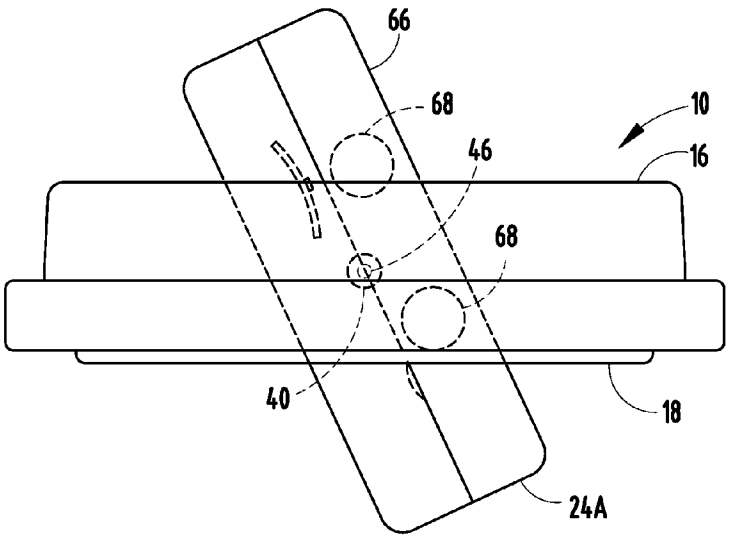
FIG. 5D is a top elevational view of the rotatable module of FIG. 4A during rotation.
Figure 6C:
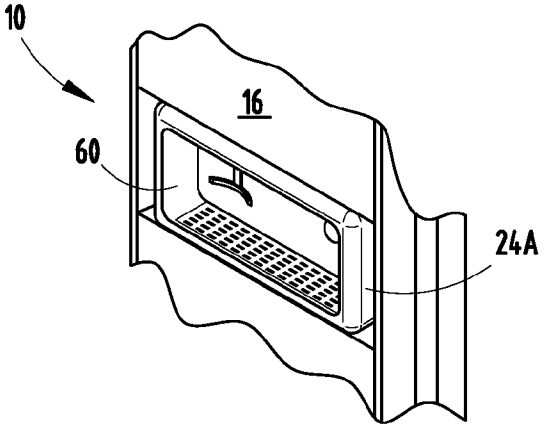
FIG. 6C is a rear perspective view of the rotatable module of FIG. 4A after rotation.
Figure 6B:
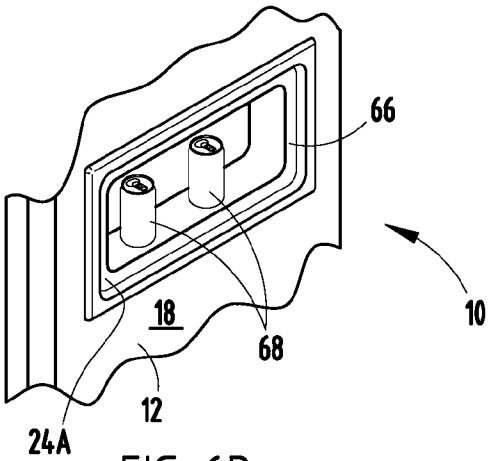
FIG. 6B is a front perspective view of the rotatable module of FIG. 4A after rotation.
Figure 6A:
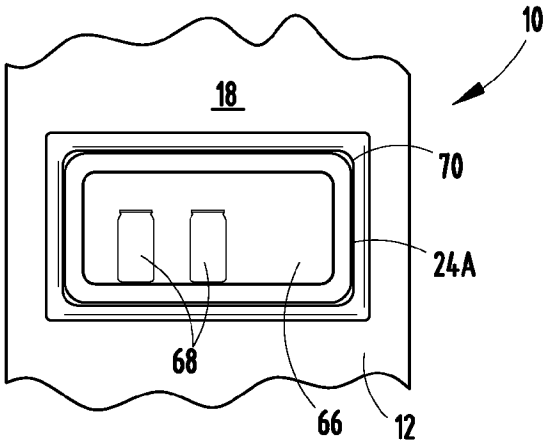
FIG. 6A is a front elevational view of the rotatable module of FIG. 4A after rotation.
Figure 6D:
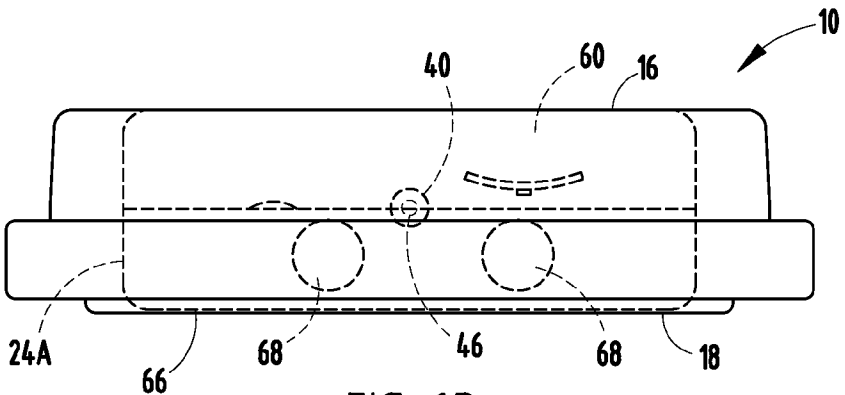
FIG. 6D is a top elevational view of the rotatable module of FIG. 4A after rotation.
Figures 7A, 7B, 7C, 7D:
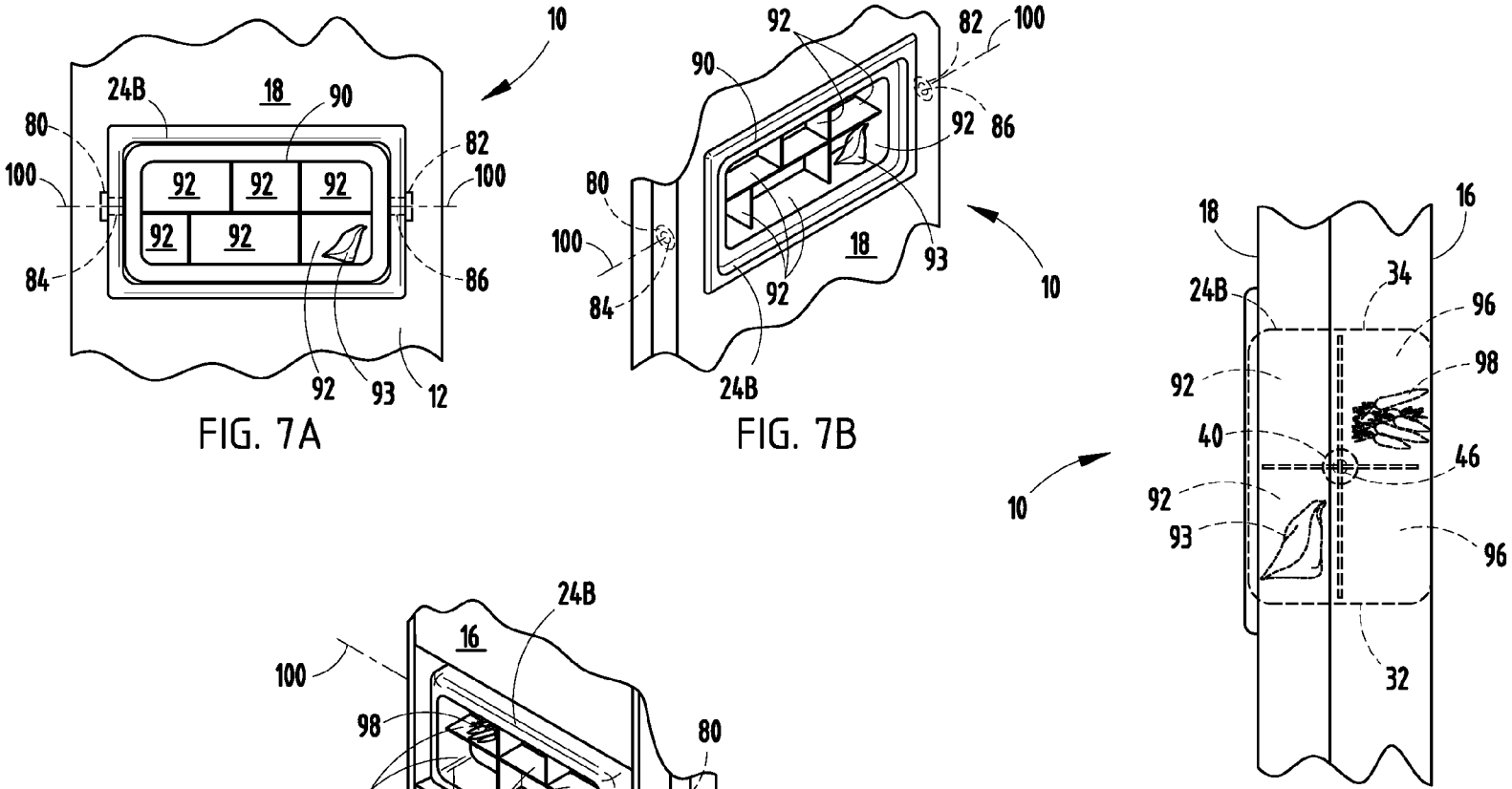
FIG. 7A is a front elevational view of a horizontally rotatable module.
FIG. 7B is a front perspective view of the rotatable module of FIG. 7A.
FIG. 7C is a rear perspective view of the rotatable module of FIG. 7A.
FIG. 7D is a top elevational view of the rotatable module of FIG. 7A.
Figures 8A, 8B, 8C, 8D:
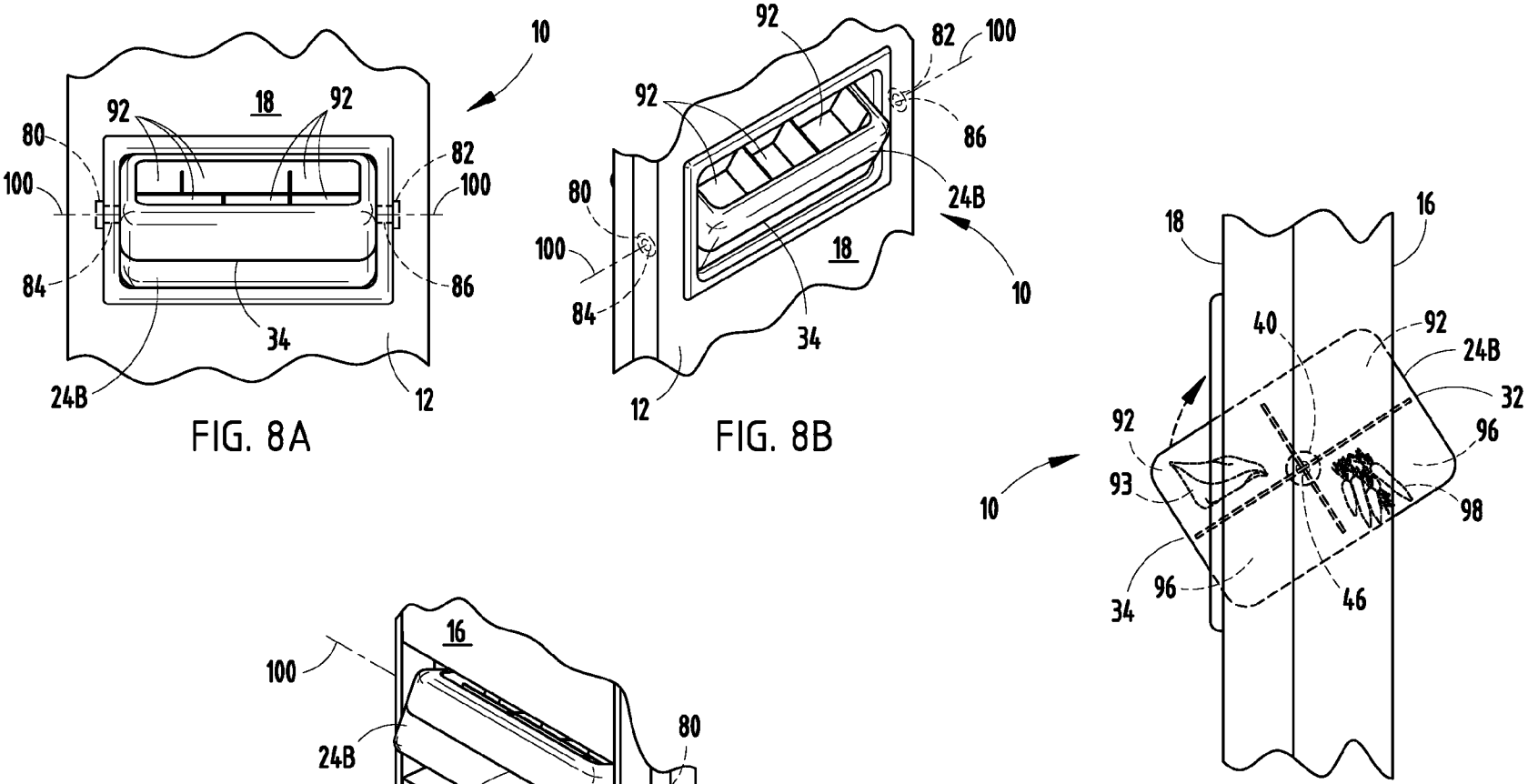
FIG. 8A is a front elevational view of the rotatable module of FIG. 7A during rotation.
FIG. 8B is a front perspective view of the rotatable module of FIG. 7A during rotation.
FIG. 8C is a rear perspective view of the rotatable module of FIG. 7A during rotation.
FIG. 8D is a top elevational view of the rotatable module of FIG. 7A during rotation.
Figures 9A, 9B, 9C, 9D:
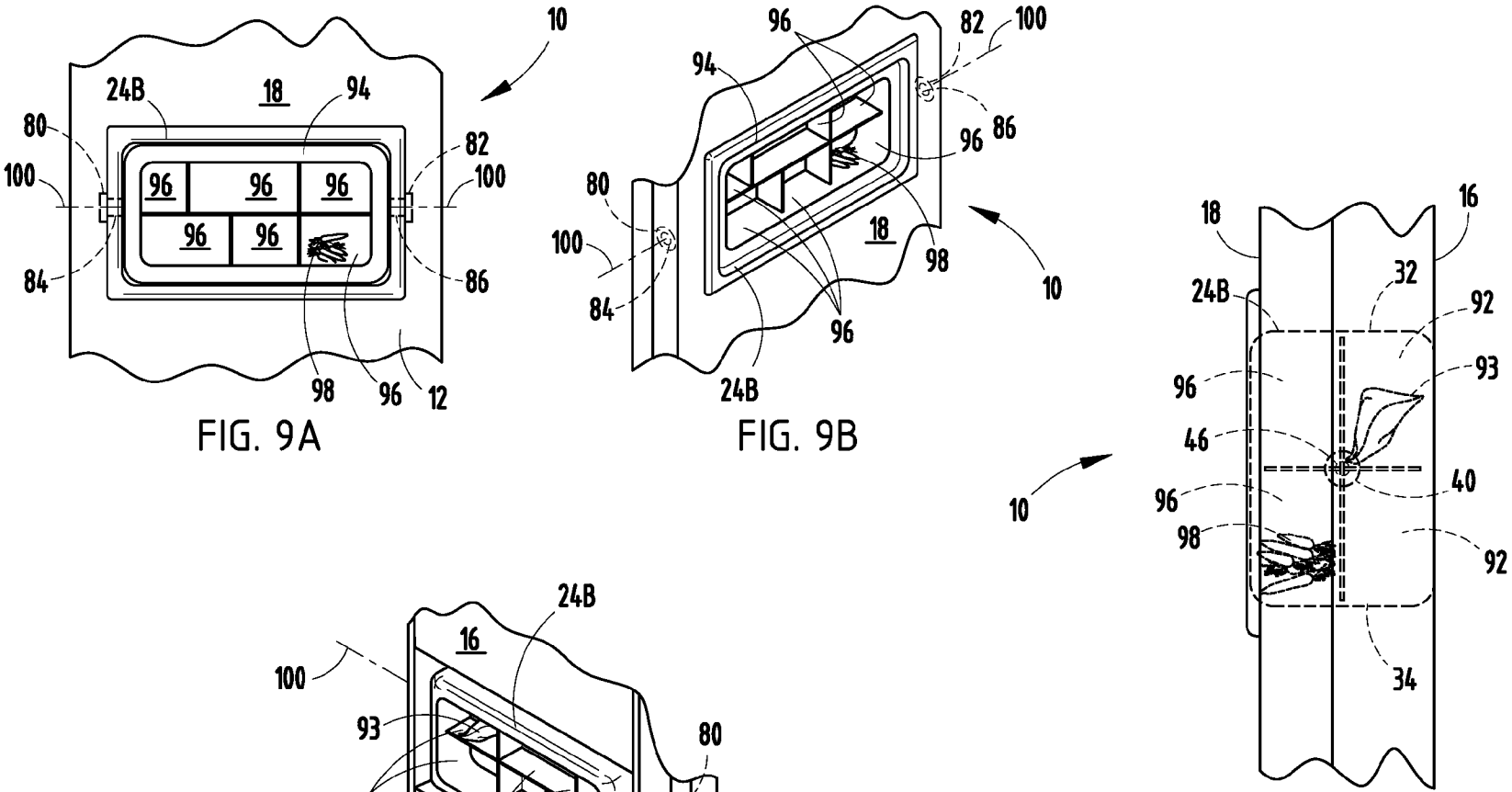
FIG. 9A is a front elevational view of the rotatable module of FIG. 7A after rotation.
FIG. 9B is a front perspective view of the rotatable module of FIG. 7A after rotation.
FIG. 9C is a rear perspective view of the rotatable module of FIG. 7A after rotation.
FIG. 9D is a top elevational view of the rotatable module of FIG. 7A after rotation.

FIGS. 4A-4D illustrate one embodiment of the horizontally-rotatable and removable module 24A. The first component includes 26 includes a water dispenser 60. Specifically, the water dispenser 60 is provided that receives water from the upper receiving hole 42 and relays water to a dispensing tube 62 that, upon actuation of a lever 64, dispenses water to a user. The backside of the rotatable removable module 24A includes a storage bin 66 adapted to hold food goods, such as canned beverages 68 (FIG. 4C). The first and second components 26, 28 are disengageably connected, such that the first component 26 and second component 28 can be disconnected (FIG. 4E) and become disengageably connected with a third component. It is contemplated that the first component 26 and second component 28 could be connected in a variety of ways, such as snap-fitting engagement, mechanical fasteners, or interlocking tabs, for example. The upper and lower pivot pins 40, 54 may be formed in a variety of ways. For example, the entire pin may extend from the first component 26 or the second component 28. Alternatively, half of the upper and lower pins may be disposed on each of the first and second components 26, 28 (FIG. 4E). Another possible construction includes the upper and lower pivot pins 40, 54 being attached to the module 24A separately and not integrally formed with either the first or second components 26, 28. Various pin arrangements are contemplated.

Referring now to FIGS. 5A-5D, the horizontally rotatable and removable module 24A is adapted to be rotated in place about the vertical axis defined by the upper and lower pivot pins 40, 54 that extend from the top and bottom walls 32, 34 of the rotatable module 24A. The connection of the utility lines 46 from the upper pivot pin 40 into the upper receiving hole 42 allow for continual rotation of the rotatable module 24A through 360 degrees. It is contemplated that the connection of the utility lines 46 could also be made through the lower pivot pin 54. A gasket 70 is disposed on an inside perimeter 72 of the module receiving aperture 22.

FIGS. 6A-6D illustrate the horizontally rotatable module 24A after having been fully rotated, such that the storage bin 66 containing food items is now readily accessible from the exterior side 18 of the appliance 12. Likewise, the water dispenser 60 is now accessible to the interior side 16 of the appliance 12. The gasket 70 disposed on the inside perimeter 72 of the module receiving aperture 22 fits closely against the top wall 32, bottom wall 34, and first and second side walls 36, 38 of the module 24A when either the first component 26 or the second component 28 of the module 24A is aligned with the module receiving aperture 22 and available from the exterior side 18 of the appliance 12.

Referring to FIGS. 7A-7D, in another embodiment of a rotatable removable module 24B, the module 24B is installed into a module receiving aperture 22. Left and right receiving holes 80, 82 engage with left and right pivot pins 84, 86 designed to engage and support the vertically rotating module 24B in place in the module receiving aperture 22. The illustrated module 24B shown in FIGS. 7A-7D has a first component 90 with a plurality of storage compartments 92, 93 designed to hold various food goods 98 and a second component 94 with a plurality of storage compartments 96 designed to hold various food goods 98. The vertically rotating module 24B operates in a similar manner to the horizontally rotating module 24A but rotates about a horizontal axis 100 defined by the left and right pivot pins 84, 86 instead of a vertical axis, as described above. The left and right receiving holes 80, 82 include utility lines 46 (FIG. 7D) designed for connection with the vertically rotating module 24B.

FIGS. 8A-8D illustrate the vertically rotating module 24B rotating in place about the horizontal axis 100 defined by the left and right pivot pins 84, 86 extending from the first and second side walls 36, 38 of the vertically rotating module 24B. FIGS. 9A-9D illustrate the vertically rotating module 24B after rotating 180 degrees, thus exposing the second component 28 of the vertically rotating module 24B to an exterior side 18 of the appliance 12 and exposing the first component 26 of the vertically rotating module 24B to an interior side 16 of the appliance 12. The vertically rotating module 24B can have a variety of components that are disengageably connected similar to the horizontally rotating module 24A discussed above.

Figure 10:
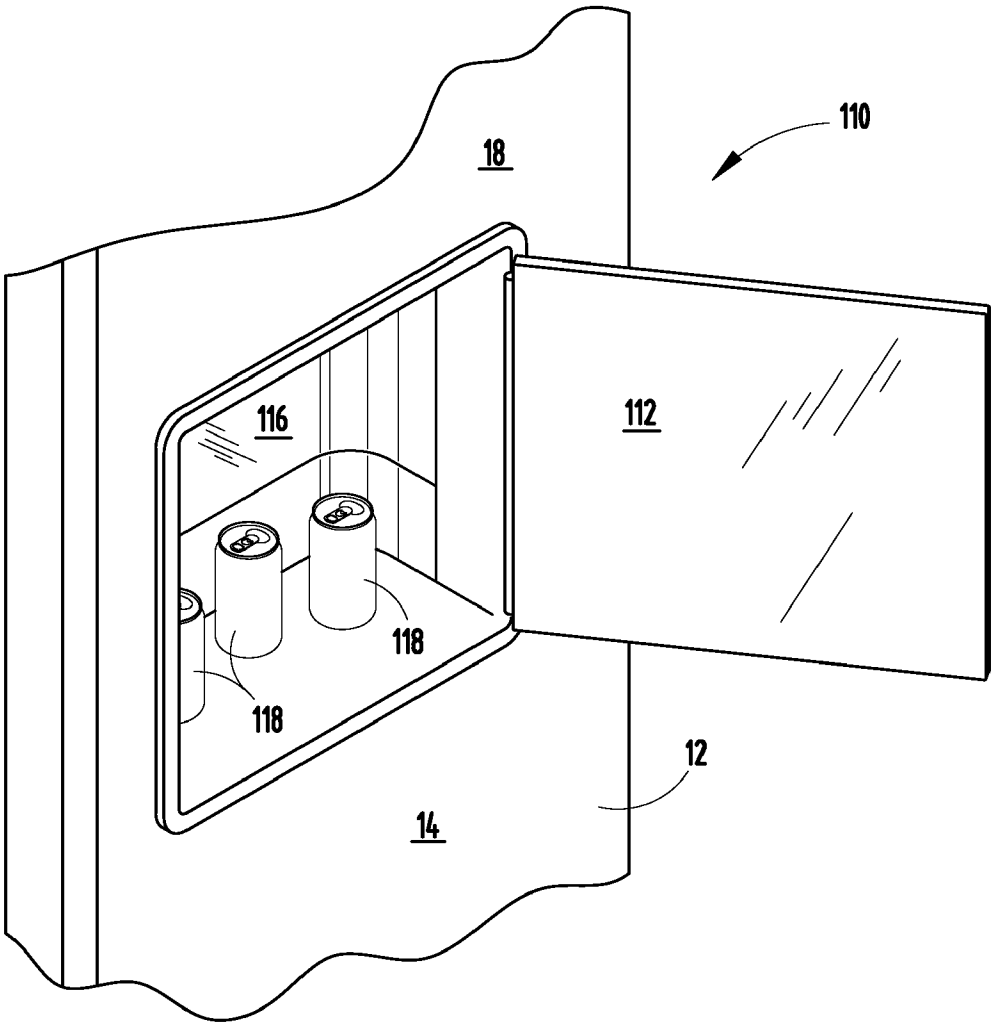
FIG. 10 is a front perspective view of a service module in a front door of a appliance.
Figure 12:
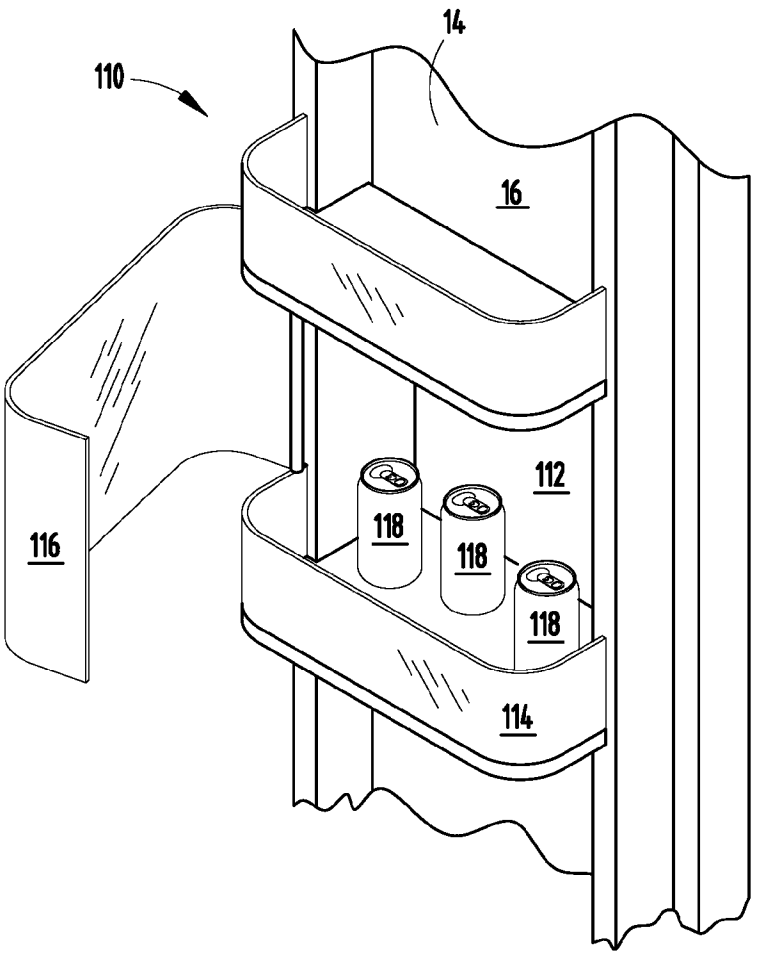
FIG. 12 is a rear perspective view of the service module of FIG. 10 with the interior access door open.
Figure 11:
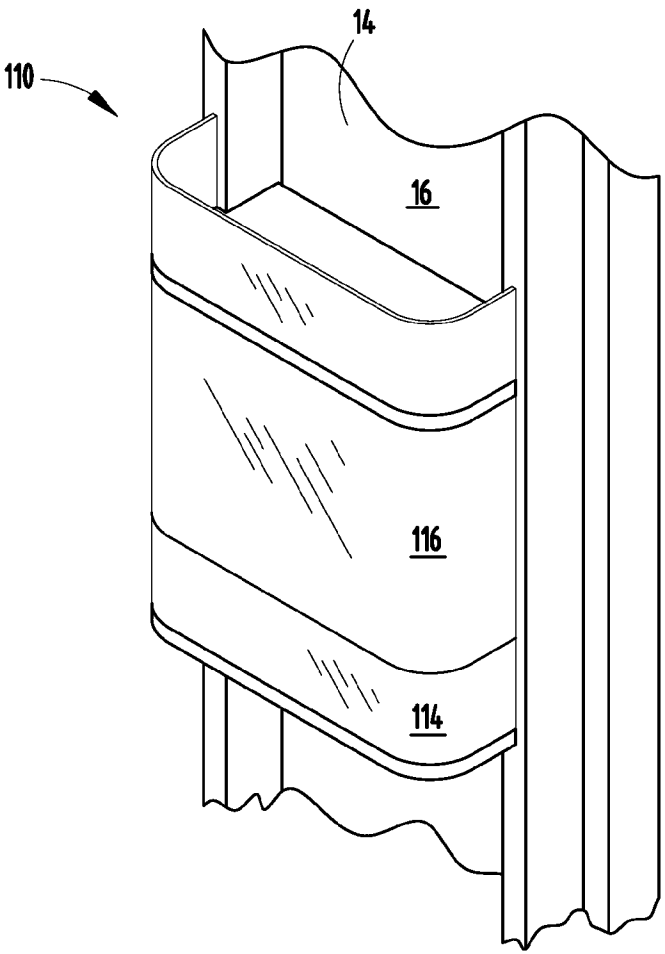
FIG. 11 is a rear perspective view of the service module of FIG. 10 with the interior access door closed.

Referring now to FIG. 10, a service module 110 includes an outside access door 112 designed to allow access to the interior of the appliance 12 without having to open the appliance door 14. As shown in FIGS. 11 and 12, an interior side 114 of the module 110 includes an interior module door 116 designed to secure food goods 118 and minimize cold air flow from inside the appliance 12 outward when the outside access door 112 is opened.

Figure 14:
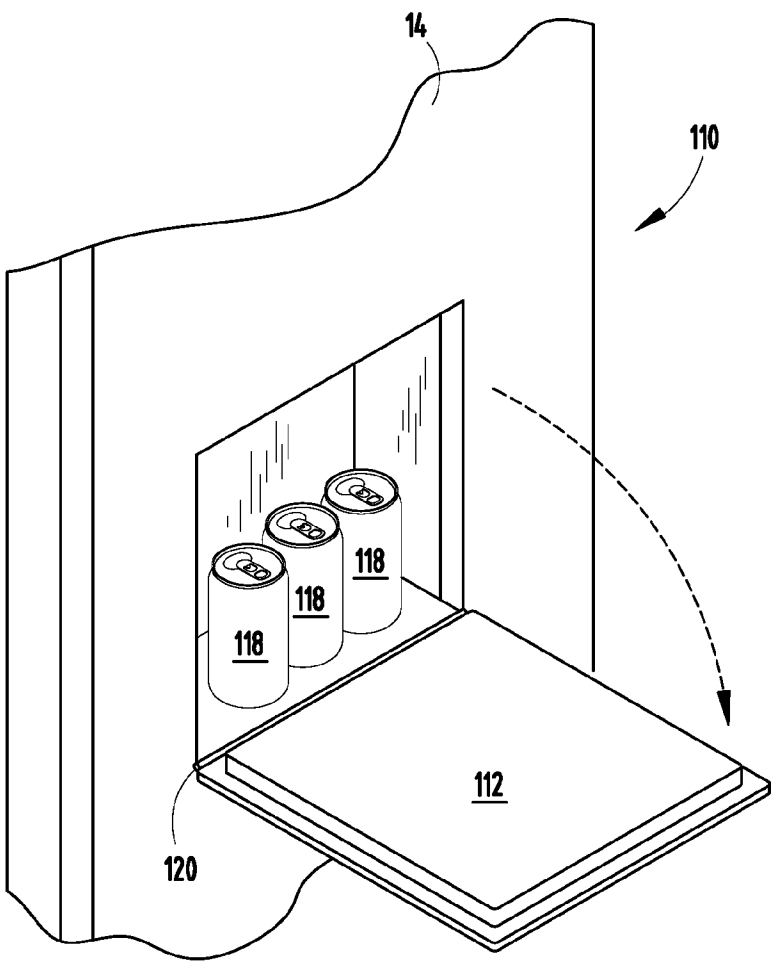
FIG. 14 is a front perspective view of the service module of FIG. 10 with the exterior door open.
Figure 13:
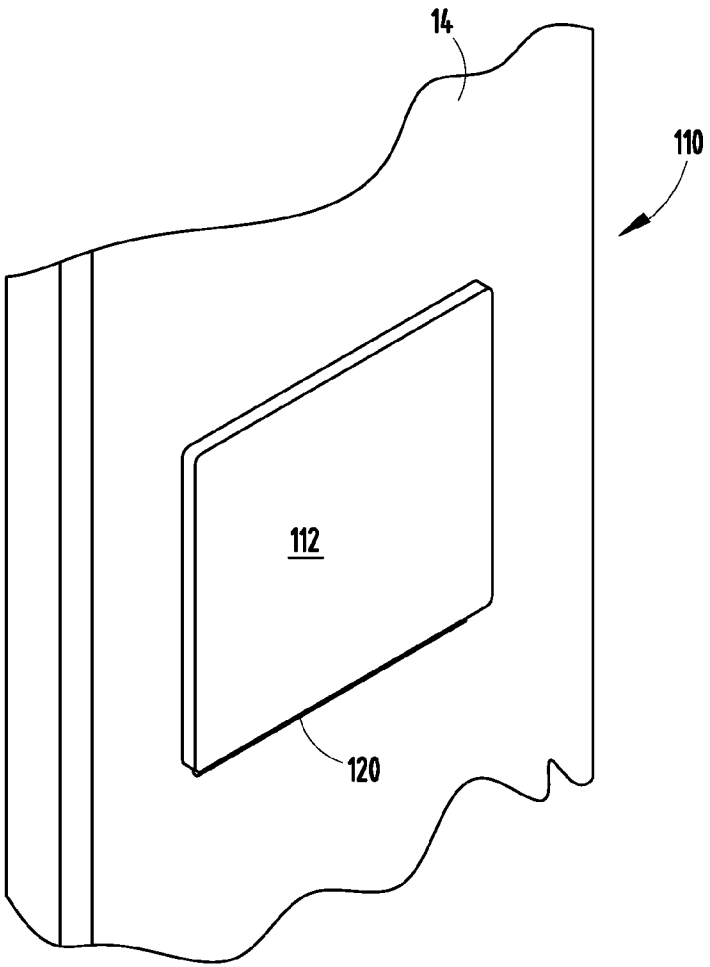
FIG. 13 is a front perspective view of the service module of FIG. 10 with the exterior door closed.
Figure 15:
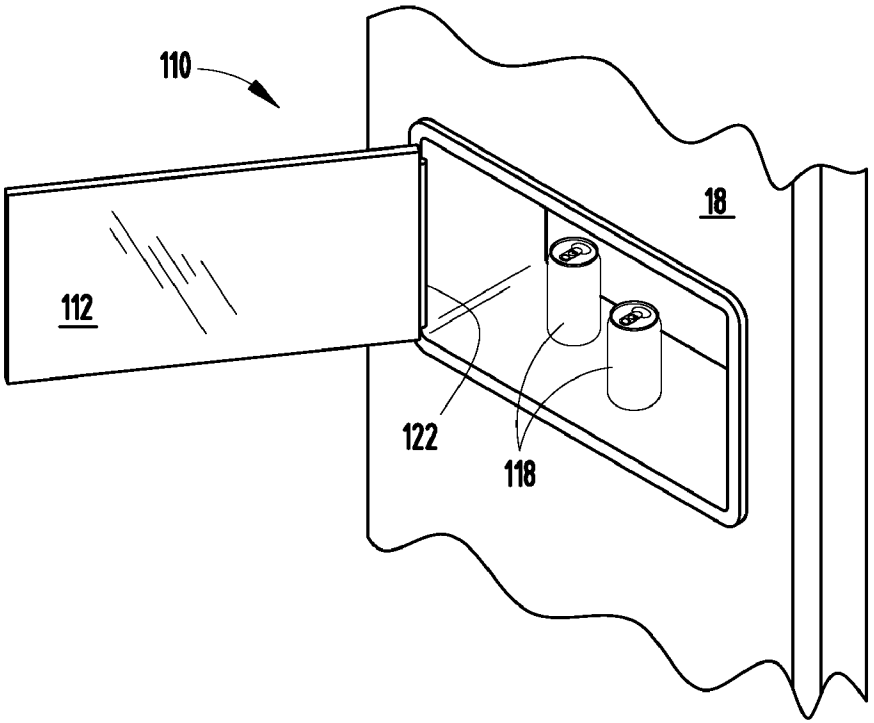
FIG. 15 is a front perspective view of another embodiment of a service module of the present invention.

In another embodiment, as shown in FIGS. 13 and 14, the outside access door 112 is rotated about a lower hinge 120, and in FIG. 15, the outside access door 112 is rotated about a side hinge 122. The outside access door 112 may be insulated to reduce cold air loss from the interior of the appliance 12 or possibly include a viewing pane to see inside the appliance 12 into the module 24.

Figure 16:
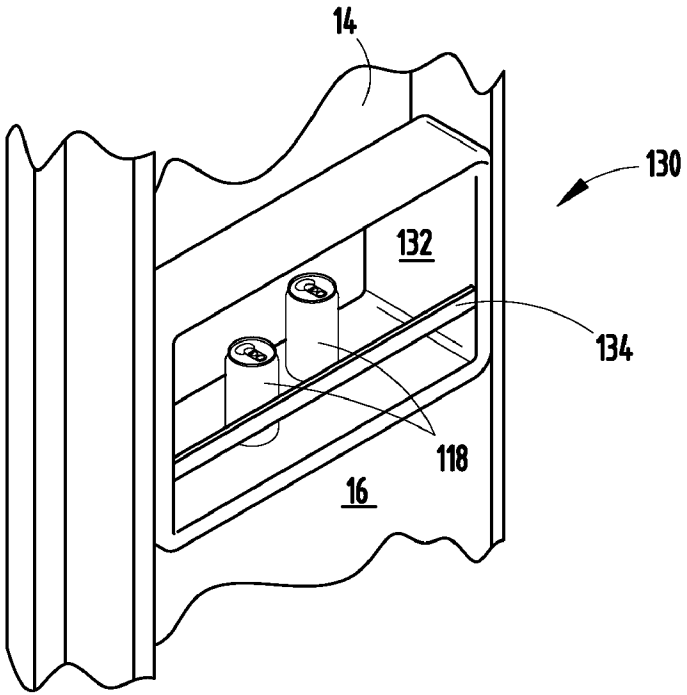
FIG. 16 is a rear perspective view of another embodiment of a service module of the present invention.

As shown in FIG. 16, another embodiment of a service module 130 has an interior portion 132 that includes a rail 134 designed to hold food goods 118 in place when the appliance door 14 is opened and closed.

The above description is considered that of the preferred embodiments only. Modifications of the invention will occur to those skilled in the art and to those who make or use the invention. Therefore, it is understood that the embodiments shown in the drawings and described above is merely for illustrative purposes and not intended to limit the scope of the invention, which is defined by the following claims as interpreted according to the principles of patent law, including the Doctrine of Equivalents.

The invention claimed is:

1. A door assembly for an appliance comprising:
a door having an interior side and an exterior side;
a frame defining an aperture extending through the door from the interior side to the exterior side; and
a module disposed in the frame and having:
a first component;
a second component disengageably connected with the first component; and
a pivot member operably coupled with the module and with the frame and defining an axis that extends substantially centrally through the module, wherein the module is rotatable about the pivot member thereby allowing access to either the first component or the second component from the exterior side of the door.

2. The door assembly of claim 1, wherein the pivot member is substantially vertically arranged such that the module rotates horizontally.

3. The door assembly of claim 1, wherein the pivot module is substantially horizontally arranged such that the module rotates vertically.

4. The door assembly of claim 1, wherein the first component and second component are disengageably attached and wherein the first component is adapted to disengageably attach with a third component.

5. The door assembly of claim 1, further comprising:
a gasket disposed between the module and the frame.

6. A door assembly for an appliance comprising:
a door having an interior side and an exterior side;
frame defining in an aperture extending through the door from the interior side to the exterior side;
a module disposed in the frame and having:
a first component;
a second component disengageably connected with the first component;
a pivot member operably coupled with the module and with the frame, wherein the module is rotatable about the pivot member thereby allowing access to both the component and the second component from the exterior side of the door;
wherein the module is disposed in the door of the appliance;
wherein the pivot member substantially vertically arranged such that the module rotates horizontally;
wherein the pivot member can also be substantially horizontally arranged such that the module rotates vertically; and
wherein the pivot member includes a hollow interior adapted to convey utility lines from the appliance to the module.

7. An appliance module disposed in a refrigerator door, the appliance module comprising:
a first side having a first removable component;
a second side having a second removable component; and
a pivot member operably connected with the appliance module and defining an axis that extends substantially centrally through the appliance module, wherein the pivot member allows rotation of the appliance module in the refrigerator door thereby providing access to either of the first or second components from an exterior portion of the refrigerator door.

8. The appliance module of claim 7, wherein the longitudinal extent of the pivot member is substantially vertically oriented such that the module rotates horizontally.

9. The appliance module of claim 7, wherein the longitudinal extent of the pivot module is substantially horizontally oriented such that the module rotates vertically.

10. The appliance module of claim 7, wherein the pivot member includes a hollow interior adapted to convey utility lines from an appliance to the module.

11. The appliance module of claim 7, wherein the first component and second component are disengageably attached and wherein the first component is adapted to disengageably attach with a third component.

12. The appliance module of claim 7, further comprising:
a gasket disposed between the module and a frame disposed in the refrigerator door.

13. A method of making an appliance module, the method comprising the steps of:
providing an appliance with a frame defining a module receiving aperture;
providing a module having a first component and removably coupled with a second component;
connecting a pivot member to the module, the pivot member defining an axis that extends substantially through the module;
removably connecting the pivot member to the frame;
inserting the frame into a door of the appliance;
extending utility lines through the pivot member to the module; and
rotating the module about the pivot member in the module receiving aperture.

14. The method of claim 13, wherein the step of removably connecting the pivot member to the frame further comprises:
orienting the longitudinal extent of the pivot member in a substantially vertical direction.

15. The method of claim 14, wherein the step of rotating the module further comprises:
rotating the module horizontally.

16. The method of claim 13, further comprising:
inserting a gasket between the module and the frame.

17. The method of claim 13, wherein the step of rotating the module further comprises:
connecting a motorized device to the module that rotates the module in the module receiving aperture.

* * * * *

UNITED STATES PATENT AND TRADEMARK OFFICE

CERTIFICATE OF CORRECTION

PATENT NO. : 8,128,184 B2
APPLICATION NO. : 12/402578
DATED : March 6, 2012
INVENTOR(S) : Paul B. Allard et al.

It is certified that error appears in the above-identified patent and that said Letters Patent is hereby corrected as shown below:

Col. 5, line 46 - Col. 6, line 6, Claim 6: "A door assembly for an appliance comprising: a door having an interior side and an exterior side; frame defining in an aperture extending through the door from the interior side to the exterior side; a module disposed in the frame and having: a first component; a second component disengageably connected with the first component; a pivot member operably coupled with the module and with the frame, wherein the module is rotatable about the pivot member thereby allowing access to both the component and the second component from the exterior side of the door; wherein the module is disposed in the door of the appliance; wherein the pivot member is substantially vertically arranged such that the module rotates horizontally; wherein the pivot member can also be substantially horizontally arranged such that the module rotates vertically; and wherein the pivot member includes a hollow interior adapted to convey utility lines from the appliance to the module." - should be Claim 6: -- A door assembly for an appliance comprising: a door having an interior side and an exterior side; a frame defining an aperture extending through the door from the interior side to the exterior side; a module disposed in the frame and having: a first component; a second component disengageably connected with the first component; a pivot member operably coupled with the module and with the frame, wherein the module is rotatable about the pivot member thereby allowing access to both the first component and the second component from the exterior side of the door; wherein the module is disposed in the door of the appliance; wherein the pivot member is substantially vertically arranged such that the module rotates horizontally; wherein the pivot member can also be substantially horizontally arranged such that the module rotates vertically; and wherein the pivot member includes a hollow interior adapted to convey utility lines from the appliance to the module. --

Signed and Sealed this
Ninth Day of October, 2012

David J. Kappos

David J. Kappos
*Director of the United States Patent and Trademark Office*